US010352068B2

(12) United States Patent
Hollis

(10) Patent No.: US 10,352,068 B2
(45) Date of Patent: Jul. 16, 2019

(54) CABLE LOCKING DEVICE

(71) Applicant: Master Lock Company LLC, Oak Creek, WI (US)

(72) Inventor: Robert Hollis, Waukesha, WI (US)

(73) Assignee: Master Lock Company LLC, Oak Creek, WI (US)

( * ) Notice: Subject to any disclaimer, the term of this patent is extended or adjusted under 35 U.S.C. 154(b) by 149 days.

(21) Appl. No.: 15/426,596

(22) Filed: Feb. 7, 2017

(65) Prior Publication Data

US 2018/0223567 A1 Aug. 9, 2018

(51) Int. Cl.

*E05B 73/00* (2006.01)
*E05B 67/00* (2006.01)
*E05B 67/38* (2006.01)

(52) U.S. Cl.

CPC ..... *E05B 73/0011* (2013.01); *E05B 67/006* (2013.01); *E05B 67/383* (2013.01)

(58) Field of Classification Search

CPC ..... E05B 73/0005; E05B 73/0011; E05B 67/003; E05B 67/006; E05B 67/383
USPC ..... 70/14, 18, 19, 30, 49, 57, 57.1, 58, 233
See application file for complete search history.

(56) References Cited

U.S. PATENT DOCUMENTS 3,950,972 A * 4/1976 Bleier ..... B62H 5/003 70/234
4,033,160 A * 7/1977 Mima ..... B62H 5/003 70/227
4,086,795 A * 5/1978 Foster ..... B62H 5/003 70/233
4,896,517 A * 1/1990 Ling ..... E05B 67/006 70/18
5,144,821 A * 9/1992 Ernesti ..... E05B 67/006 292/DIG. 69
5,156,028 A 10/1992 Jiang
(Continued)

FOREIGN PATENT DOCUMENTS

EP 2942458 A2 11/2015

OTHER PUBLICATIONS

Search Report for European Patent Application No. 18155619.2 dated Jul. 5, 2018.

(Continued)

*Primary Examiner* — Lloyd A Gall
(74) *Attorney, Agent, or Firm* — Calfee, Halter & Griswold LLP

(57) ABSTRACT

A cable locking device includes a housing, a cable extending outward through a cable passage in the housing and terminating at a cable end connector receivable in a cable connection port in the housing, and a locking mechanism assembled with the housing and movable between a locked position and an unlocked position. When the locking mechanism is in the locked position, a first cable securing portion secures the cable against movement within the cable passage in at least an outward direction, and a second cable securing portion secures the cable end connector within the cable connection port. When the locking mechanism is in the unlocked position, the first cable securing portion permits movement of the cable within the cable passage in the outward direction, and the second cable securing portion permits removal of the cable end connector from the cable connection port.

20 Claims, 9 Drawing Sheets

(56) References Cited

U.S. PATENT DOCUMENTS 5,768,920 A * 6/1998 DeBevoise ..... E05B 73/0005 70/18
5,786,759 A * 7/1998 Ling ..... B62J 3/00 340/542
5,823,020 A * 10/1998 Benda ..... E05B 67/003 70/18
5,960,652 A * 10/1999 Marmstad ..... E05B 73/0011 70/233
6,526,785 B1 3/2003 Asenstorfer
6,609,399 B1 * 8/2003 Daniels, Jr. ..... B62H 5/003 70/14
6,629,440 B1 * 10/2003 Meekma ..... A63C 11/006 70/14
6,681,603 B1 1/2004 Yu
6,755,054 B2 6/2004 Burmesch et al.
7,021,091 B2 4/2006 Leyden et al.
7,152,439 B1 * 12/2006 Chang ..... E05B 37/025 70/30
7,162,899 B2 1/2007 Fawcett et al.
7,168,275 B2 1/2007 Fawcett et al.
7,207,198 B2 * 4/2007 Benda ..... F16K 35/10 137/385
7,251,966 B2 8/2007 Fawcett et al.
7,272,962 B2 9/2007 Benda et al.
7,293,438 B2 11/2007 Benda
7,350,381 B2 4/2008 Fawcett et al.
7,481,086 B2 1/2009 Fawcett et al.
7,497,100 B2 3/2009 Fawcett et al.
7,497,101 B2 3/2009 Fawcett et al.
7,526,932 B2 * 5/2009 Funtmann ..... A63C 11/006 70/14
7,784,313 B2 8/2010 Wyers
7,918,112 B2 4/2011 Fawcett et al.
8,087,269 B2 1/2012 Conti et al.
8,122,744 B2 2/2012 Conti et al.
8,281,626 B2 10/2012 Conti et al.
8,347,663 B2 1/2013 Fawcett et al.
8,499,595 B2 8/2013 Zhang et al.
8,528,370 B2 9/2013 Yu et al.
8,578,743 B2 * 11/2013 Yu ..... E05B 37/025 70/30
8,599,022 B2 12/2013 Conti et al.
8,773,267 B2 7/2014 Conti et al.
8,800,330 B2 8/2014 Fawcett et al.
9,032,764 B2 5/2015 Yeh et al.
9,234,371 B2 1/2016 Conti et al.
9,388,606 B2 7/2016 Garthe et al.
9,394,727 B2 7/2016 Fawcett et al.
9,447,611 B2 9/2016 Conti et al.
2005/0092037 A1 * 5/2005 Meekma ..... E05B 37/025 70/30
2006/0075794 A1 * 4/2006 Ling ..... E05B 71/00 70/58
2008/0314094 A1 12/2008 Shu
2009/0113946 A1 * 5/2009 Baumgarten ..... E05B 67/006 70/18
2011/0277700 A1 * 11/2011 Friedland ..... A01K 1/04 119/792
2012/0227447 A1 9/2012 Conti

OTHER PUBLICATIONS

Examination Report for European Patent Application No. 18155619.2 dated Mar. 28, 2019.

* cited by examiner

CABLE LOCKING DEVICE

BACKGROUND

Security devices, such as for example, padlocks and other types of conventional locks are known in the art. Many security devices are provided for restricting access to enclosures, for example, by securing hasps or other lock points on doors or gates, or for restricting access to equipment and control instruments, including, for example, electrical components, such as switches, dials, push buttons, and electrical connections, and fluid system components, such as valves, pressure regulators, and fluid conduit fittings and connectors. Some locking devices are provided with an adjustable and/or selectively detachable cable that may be secured around or through a lock feature (e.g., a hasp, latch, or other such feature) to provide a locking condition.

SUMMARY

In accordance with an aspect of the present application, in an exemplary embodiment, a cable locking device includes a housing, a reel at least partially disposed in the housing and rotatable in a first, cable tightening direction and a second, cable loosening direction, a cable having a first end portion fixed to the reel and a second end portion extending outward through a cable passage in the housing, at least one clamp member disposed in the housing and defining at least a portion of the cable passage, and a locking mechanism assembled with the housing and movable between a locked position and an unlocked position. The at least one clamp member is movable between a clamping position in which the at least one clamp member engages a portion of the cable disposed in the cable passage to prevent movement of the cable within the cable passage in at least an outward direction, and a releasing position in which the at least one clamp member permits movement of the cable within the cable passage in the outward direction. The locking mechanism includes a reel securing portion and a clamp member securing portion, wherein when the locking mechanism is in the locked position, the reel securing portion secures the reel against rotation in the cable loosening direction, and wherein when the locking mechanism is in the unlocked position, the clamp member securing portion secures the at least one clamp member in the releasing position.

In another exemplary embodiment, a cable locking device includes a housing, a reel at least partially disposed in the housing and rotatable in a first, cable tightening direction and a second, cable loosening direction, the reel including a plurality of latch portions disposed around a periphery of the reel, a cable having a first end portion fixed to the reel and a second end portion extending outward through a cable passage in the housing, and a locking mechanism assembled with the housing. The locking mechanism includes a latching lever that engages an aligned one of the plurality of latch portions, and a locking cam that pivots the latching lever out of engagement with the plurality of latch portions when the locking cam is rotated from a locked position to an unlocked position, to permit rotation of the reel in the cable loosening direction.

In another exemplary embodiment, a cable locking device includes a housing, a cable having a first end portion retained within the housing and a second end portion extending outward through a cable passage in the housing and terminating at a cable end connector, the cable end connector being receivable in a cable connection port in the housing, and a locking mechanism assembled with the housing and movable between a locked position and an unlocked position, the locking mechanism including a first cable securing portion and a second cable securing portion. When the locking mechanism is in the locked position, the first cable securing portion secures the cable against movement within the cable passage in at least an outward direction, and the second cable securing portion secures the cable end connector within the cable connection port. When the locking mechanism is in the unlocked position, the first cable securing portion permits movement of the cable within the cable passage in the outward direction, and the second cable securing portion permits removal of the cable end connector from the cable connection port.

BRIEF DESCRIPTION OF THE DRAWINGS

Further features and advantages of the invention will become apparent from the following detailed description made with reference to the accompanying drawings, wherein.

DETAILED DESCRIPTION

The Detailed Description merely describes exemplary embodiments and is not intended to limit the scope of the claims in any way. Indeed, the invention as claimed is broader than and unlimited by the exemplary embodiments, and the terms used in the claims have their full ordinary meaning. Also, while specific exemplary embodiments in the present application describe cable lockout devices including an enclosed ratcheting cable retaining reel and a connection port for securing a terminal end of the cable, one or more of the features described herein may additionally or alternatively be applied to other types of cable locking devices, including, for example, locking devices that do not have an internal reel, locking devices with cables that do not have a detachable end portion, locking devices that do not have a ratcheting or cinching feature.

According to an aspect of the present application, a cable locking device may be provided with an internal reel rotatable in a cable tightening direction, for example, for retaining an unused portion of a cable and/or for cinching or securing the cable through or around a locking feature, and rotatable in a cable loosening direction, for example, for releasing the cable from the locking feature. The cable locking device may be provided with a locking mechanism configured to secure the reel against rotation in at least the cable loosening direction when the locking mechanism is in a locked position, and to permit the reel to rotate in the cable loosening direction when the locking mechanism is in an unlocked position.

Figure 1:
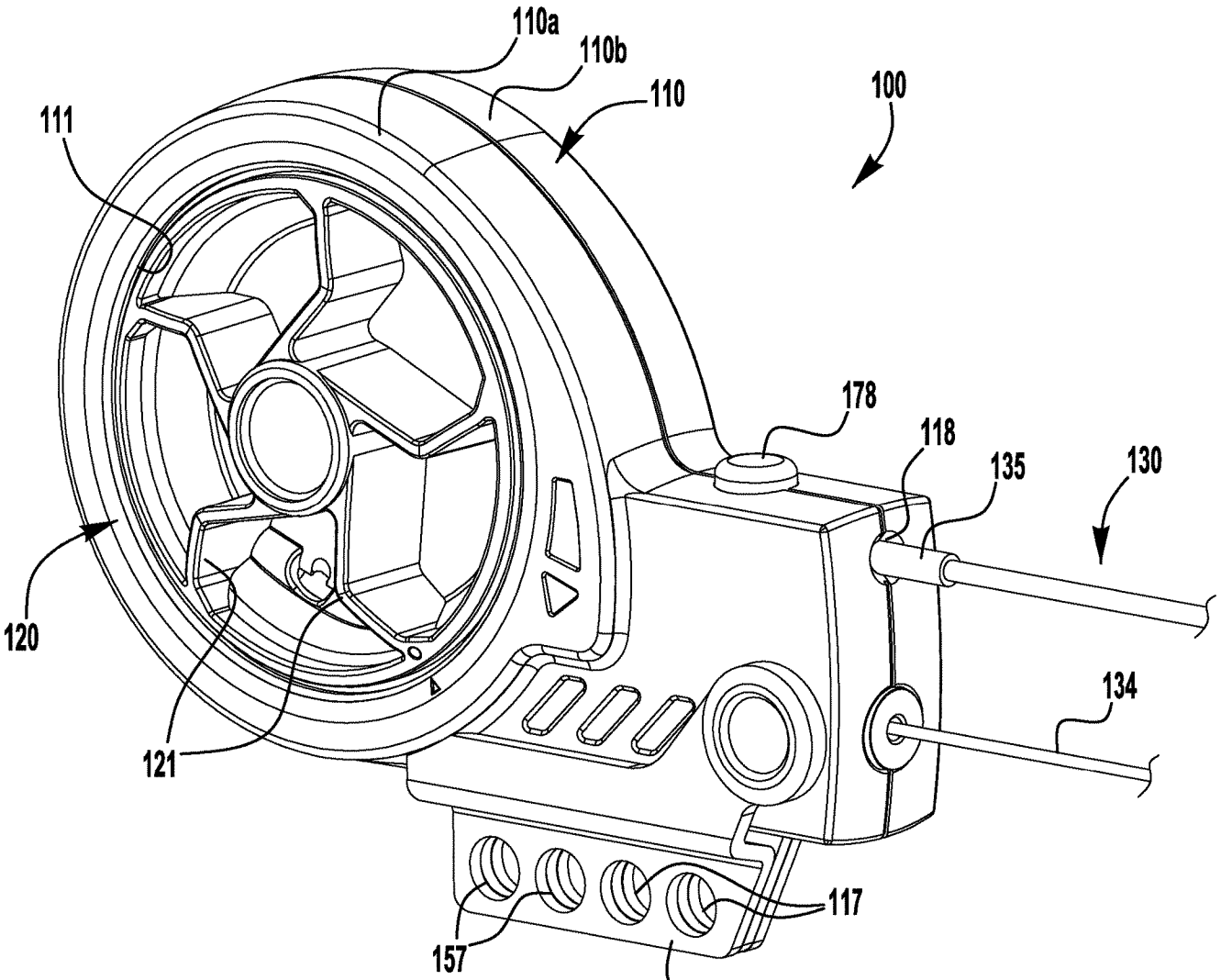
FIG. 1 illustrates a perspective view of a cable locking device, in accordance with an exemplary embodiment of the present application, shown with the locking mechanism in a locked position.
Figure 1A:
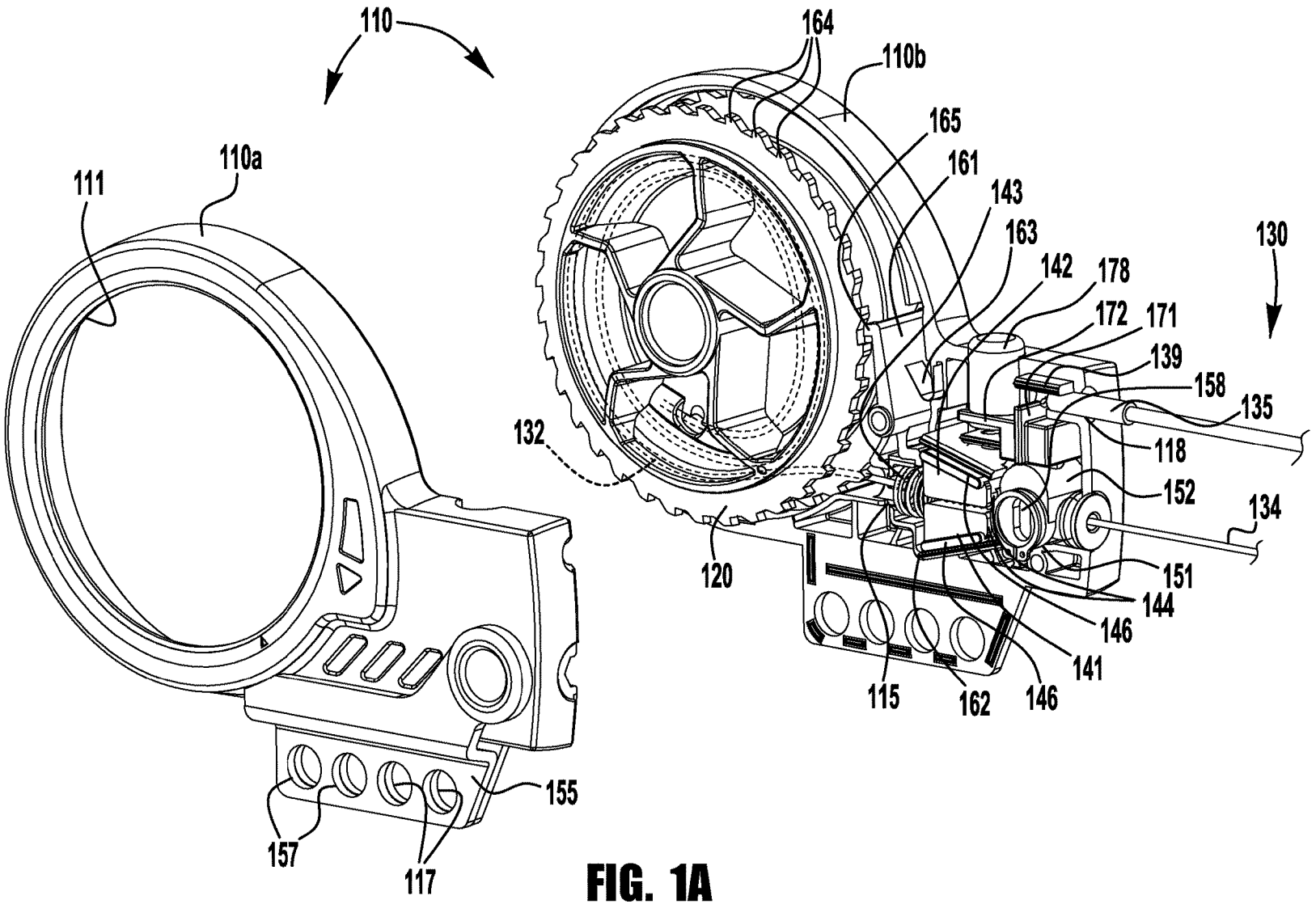
FIG. 1A illustrates a front view of the cable locking device of FIG. 1, shown with the locking mechanism in the locked position and with a housing half and lockout member removed to illustrate additional features of the device.
Figure 2:
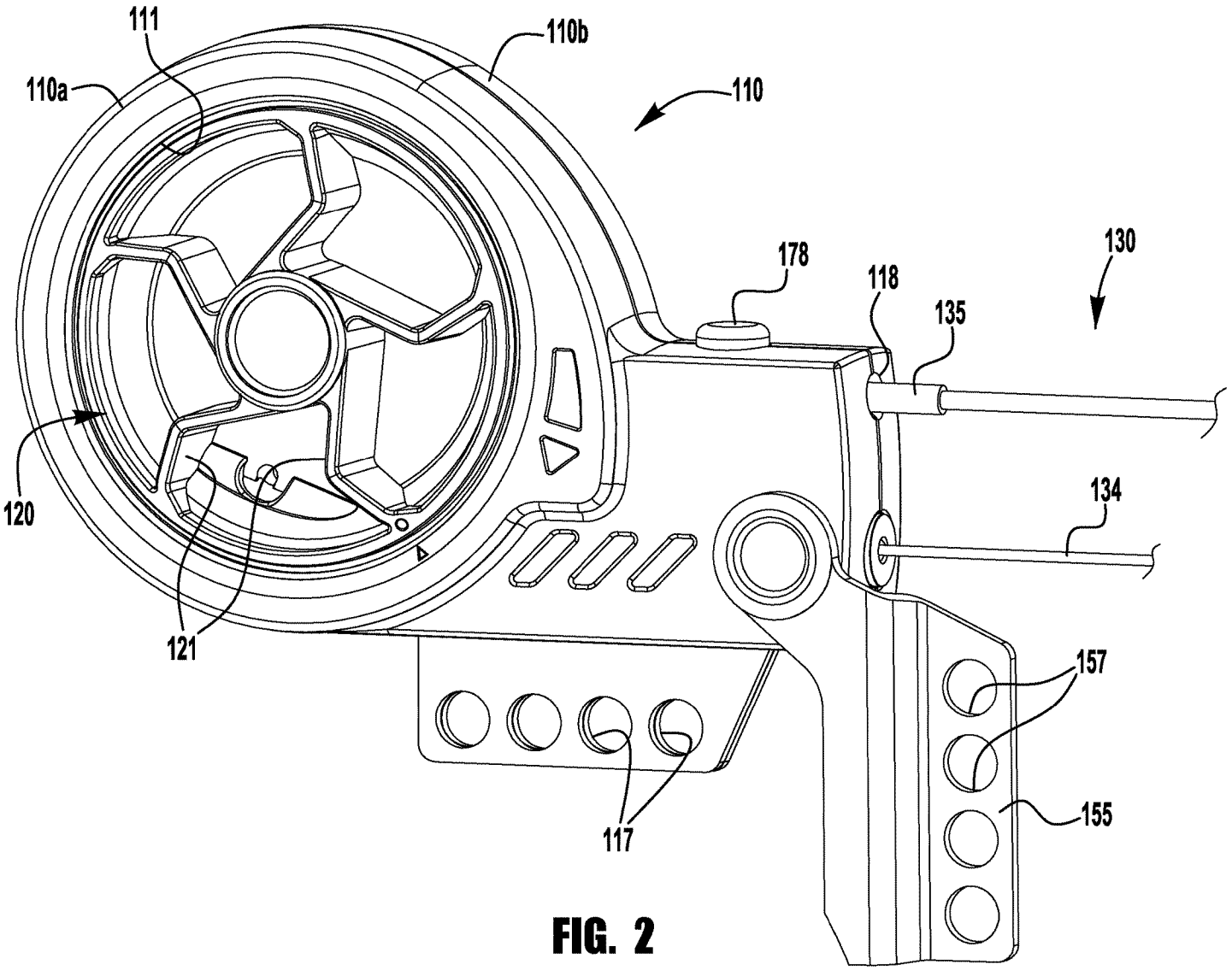
FIG. 2 illustrates a perspective view of the cable locking device of FIG. 1, shown with the locking mechanism in an unlocked position and with the cable end connector detached from the housing.
Figure 2A:
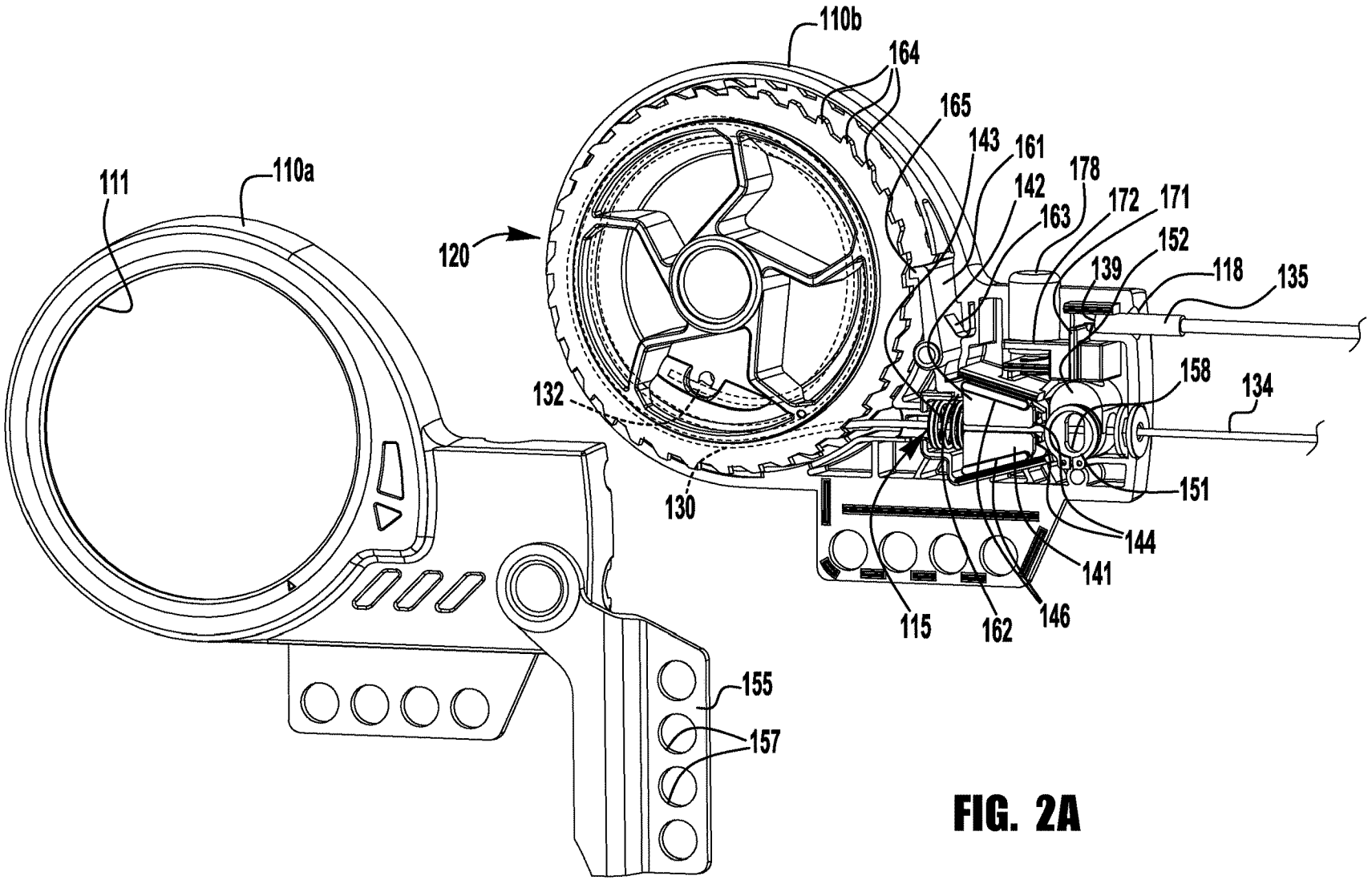
FIG. 2A illustrates a front view of the cable locking device of FIG. 1, shown with the locking mechanism in the unlocked position, with the cable end connector detached from the housing, and with a housing half and lockout member removed to illustrate additional features of the device.
Figure 3:
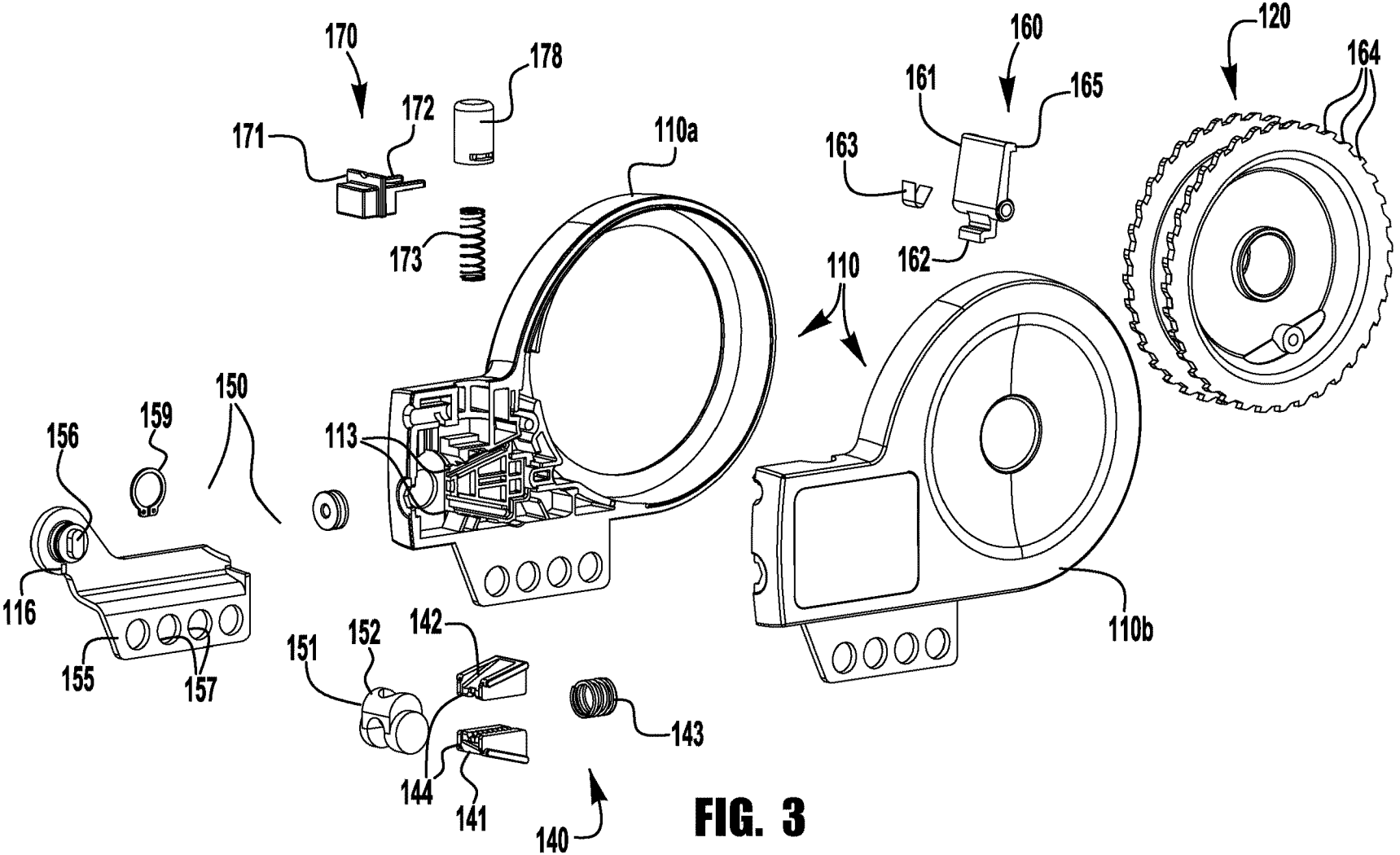
FIG. 3 illustrates an exploded view of the cable locking device of FIG. 1, shown without the cable.
Figure 4:
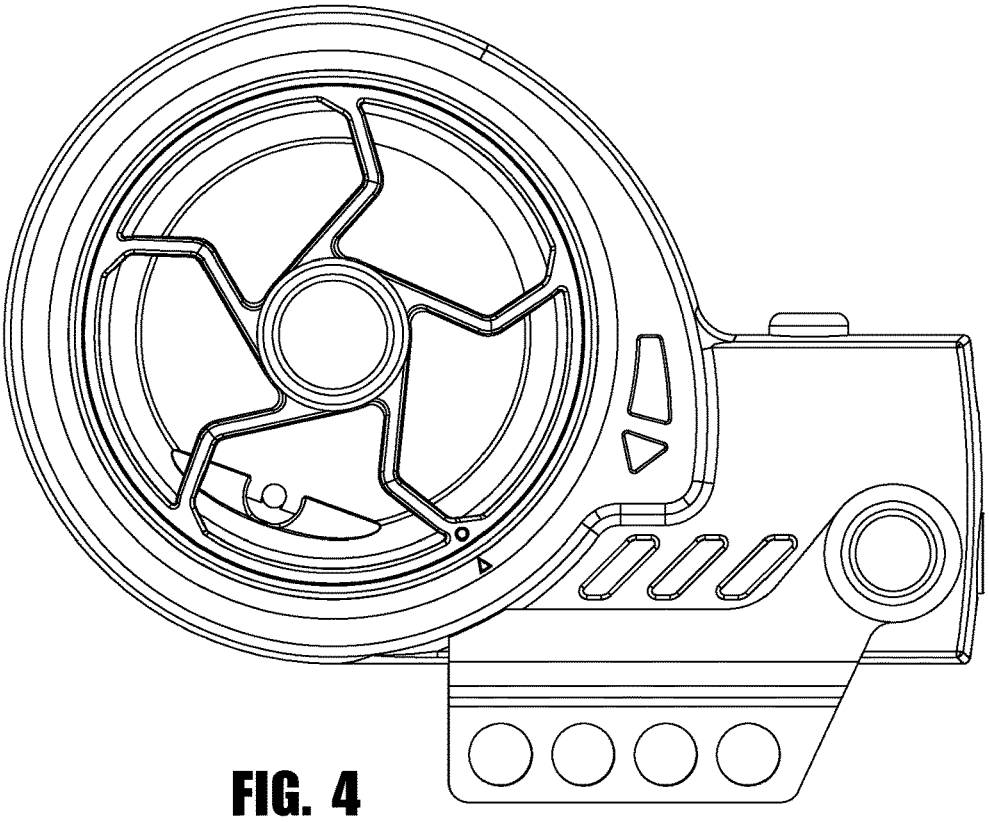
FIGS. 4-11 illustrate front elevational, rear elevational, left side elevational, right side elevational, top plan, bottom plan, top-front-right perspective, and bottom-rear-left perspective views of an exemplary cable locking device of the present application, shown without the cable.
Figure 5:
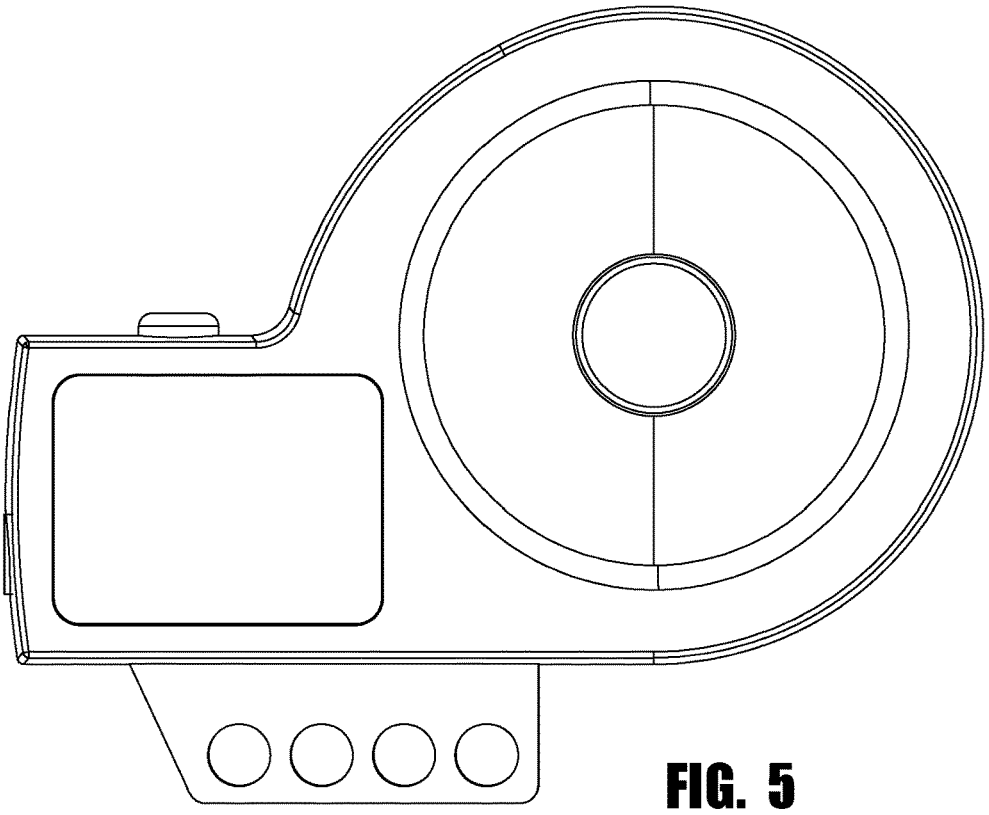
Figure 6:
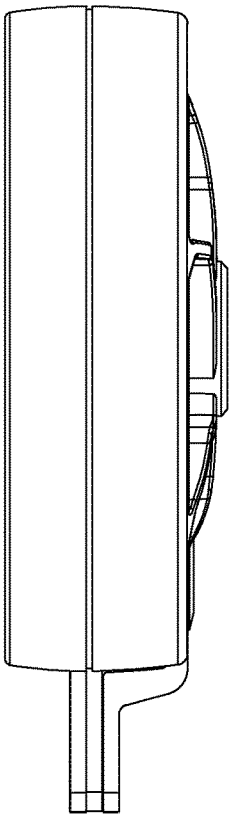
Figure 7:
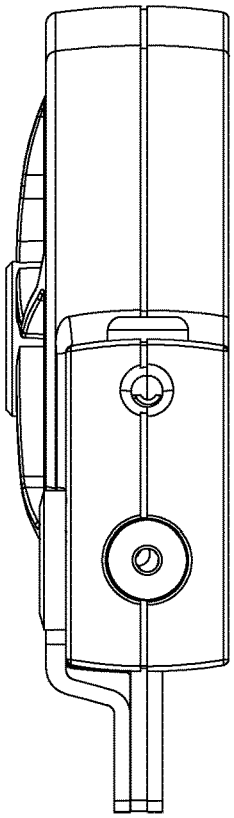
Figure 8:
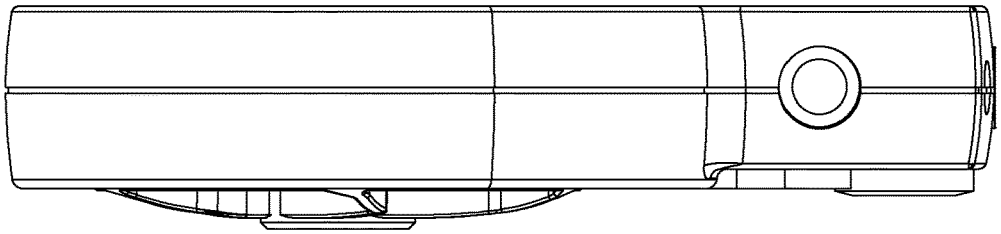
Figure 9:
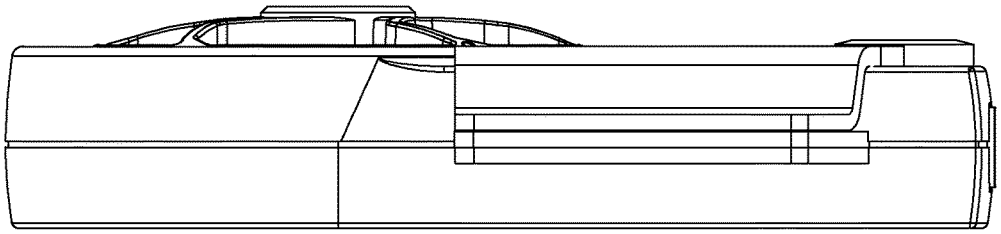
Figure 10:
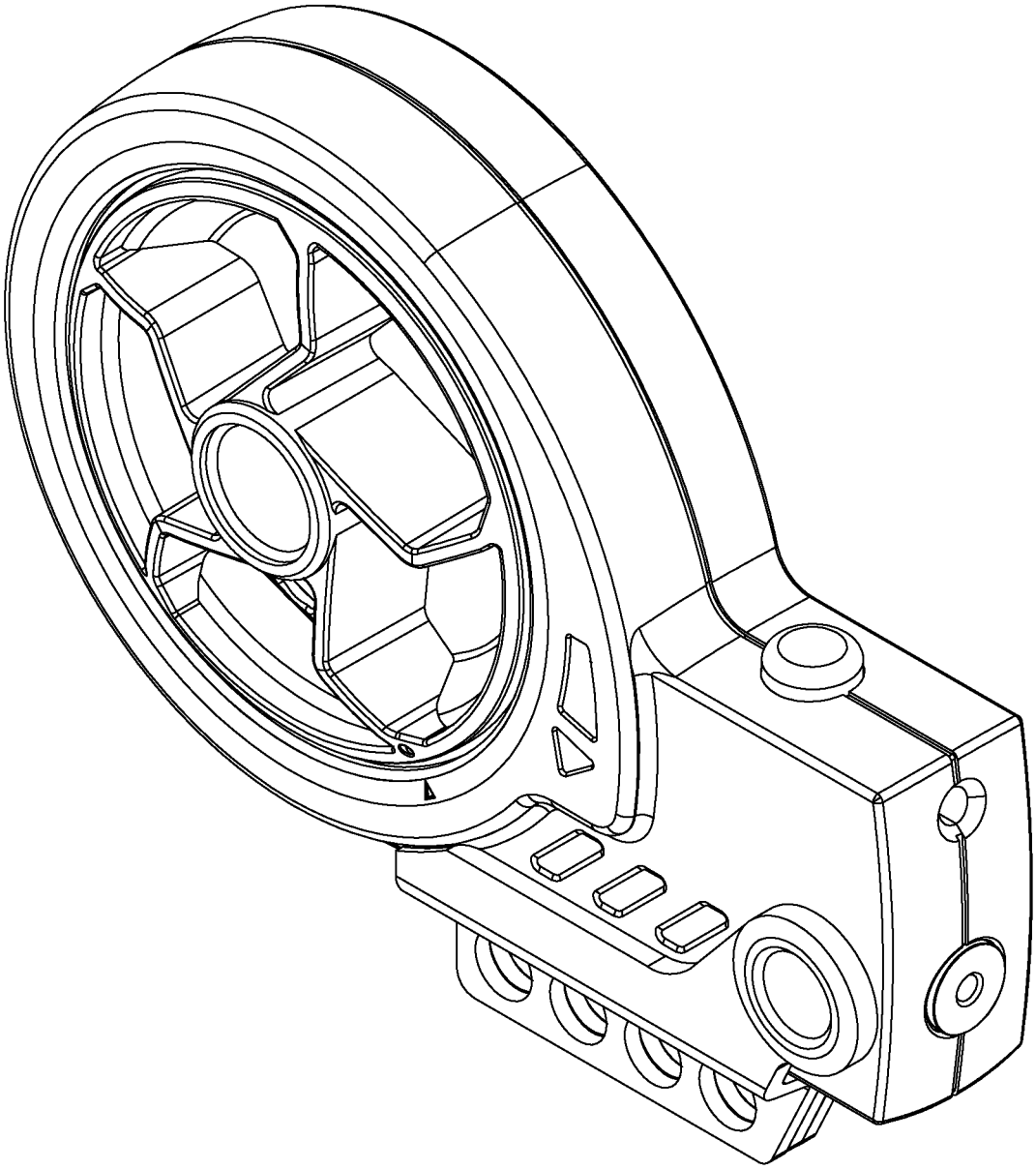
Figure 11:
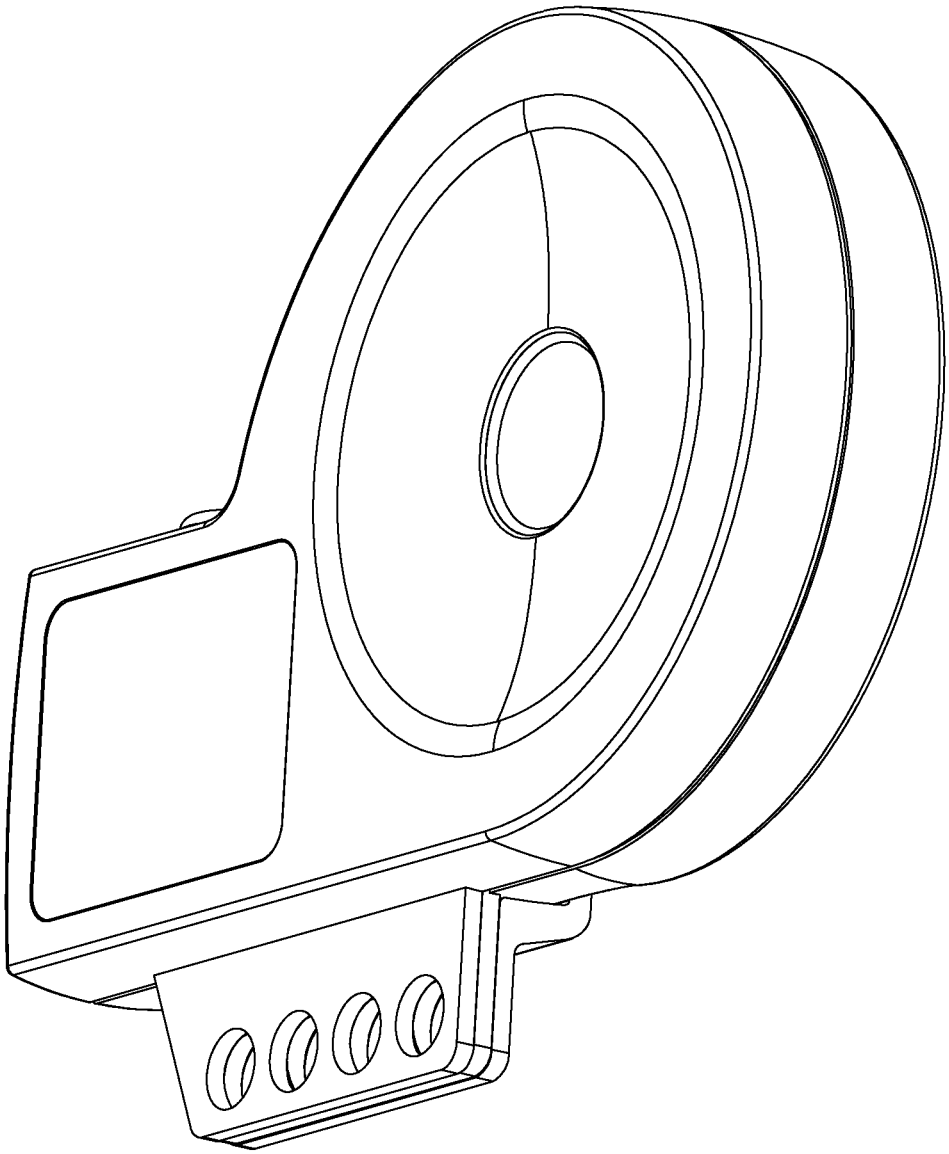

FIGS. 1-3 illustrate an exemplary embodiment of a cable locking device 100 including a housing 110, a reel 120 partially disposed in the housing, and a cable 130 having a first end portion 132 fixed to the reel and a second end portion 134 extending outward through a cable passage 115 (FIGS. 1A, 2A) in the housing. The reel 120 is rotatable in a cable tightening direction to retract at least a portion of the second end portion of the cable into the housing, through the cable passage 115 and onto the reel 120, and in a cable loosening direction to withdraw at least a portion of the second end portion of the cable from the housing 110, through the cable passage. As shown, an outer portion 121 of the reel 120 may be exposed (e.g., through an opening 111 in the housing 110) and may include one or more user graspable features (e.g., ribs, pockets, etc.) to facilitate user rotation of the reel. The housing 110 may be formed from two housing halves 110*a*, 110*b* secured together, for example, by welding, adhesive, fasteners, or any other suitable arrangement.

According to an aspect of the present application, the cable locking device includes at least one cable securing feature or cable securing portion that secures the cable against loosening or withdrawal from the housing. As one example, a cable securing portion may include at least one gripping or clamping member that defines a portion of the cable passage and grips or clamps against the portion of the cable in the cable passage to prevent movement of the cable within the cable passage in at least an outward or loosening direction. While many different types of clamping members may be utilized, in the illustrated embodiment, a clamping portion or clamping arrangement 140 (FIG. 3) includes first and second clamp jaws 141, 142 that are spring-biased (by spring 143) into a clamping position for clamping engagement with the cable 130. When a tensile or pulling force is applied to the external or withdrawn portion of the cable, the clamp jaws 141, 142 are pulled, by the engaged portion of the cable, into tighter gripping engagement with the cable. In the illustrated embodiment, when the reel 120 is rotated in the cable tightening direction, the clamp jaws 141, 142 are pulled, by the engaged portion of the cable, against the biasing spring 143 and into a releasing position, to allow retraction of the cable through the cable passage 115 and onto the reel. In the illustrated embodiment, the clamp jaws 141, 142 include protrusions 146 that slideable in angled tracks 113 in the housing (FIG. 3) between the clamping and releasing positions, such that an axial force in the tightening direction slides the clamp jaws 141, 142 laterally outward for release of the cable, and an axial force in the loosening direction slides the clamp jaws laterally inward for clamping engagement with the cable.

To allow for loosening or withdrawal of an additional portion of the cable from the housing, a locking mechanism may be provided that, when moved from a locked position to an unlocked position, causes or permits movement of the clamping portion from the clamping position to the releasing position. In the illustrated embodiment, the locking mechanism 150 (FIG. 3) includes a locking cam 151 having an actuating portion 152. Movement of the locking mechanism to the unlocked position causes the actuating portion 152 to engage actuated portions 144 of the clamp jaws 141, 142 and move the clamp jaws against the biasing spring 143 and into the releasing position. While many different types of locking mechanism interfaces may be utilized (e.g., key cylinder, combination dial mechanism, etc.), in the illustrated embodiment, the locking mechanism includes a user manipulable lockout member or lockout plate 155 that is pivotably connected with the housing 110 (e.g., by a retaining ring 159, FIG. 3) and is connected with the locking cam 151 (e.g., by a keyed projection 156, FIG. 3, and recess 158, FIG. 1A) for rotation of the locking cam when the lockout member 155 is pivoted with respect to the housing. When the locking mechanism 150 is in the locked position (FIGS. 1 and 1A), the lockout member 155 is oriented in a first position to hold the locking cam 151 in a position in which the actuating portion 152 is disengaged from the jaws 141, 142. When the locking mechanism 150 is in the unlocked position (FIGS. 2 and 2A), the lockout member 155 is oriented in a second position to hold the locking cam 151 in a position in which the actuating portion 152 is engaged with the actuated portions 144 of the clamp jaws 141, 142 to force the jaws into the releasing position. As shown in FIG. 3, the housing 110 and/or the lockout member 155 may be provided with a detent feature 116 that provides for snap-fit retention of the lockout member 155 in a selected one of the first and second positions.

To secure the locking mechanism in the locked position, at least one of the lockout member and the housing may be provided with at least one lock aperture through which a locking member (e.g., a padlock shackle) may be secured to block or prevent movement of the lockout member from the first (or lockout) position to the second (or released) position. In the illustrated embodiment, the lockout member 155 includes a plurality of lock apertures 157 that align with a corresponding plurality of apertures 117 in the housing 110 when the lockout member is in the first position. When one or more locking members are inserted through one or more of the aligned sets of apertures 117, 157, movement of the lockout member from the first position to the second position, and corresponding movement of the locking cam actuating portion 152 into engagement with the jaws 141, 142, are prevented.

In the illustrated embodiment, the spring loaded jaw arrangement and locking cam disengagement from the jaws in the locked position allow for cinching or tightening of the cable when the locking mechanism is in the locked position. In other embodiments (not shown), the locking mechanism may additionally or alternatively provide for a condition in which the locking mechanism (e.g., using the locking cam) secures the clamping portion in clamping engagement with the cable, such that the cable may not be tightened or cinched in such a condition. This condition may coincide with the locked position of the locking mechanism, or may be provided as a third selectable position of the locking mechanism.

According to another exemplary aspect of the present application, a cable securing portion of a cable locking device may additionally (i.e., in addition to the clamping portion described above) or alternatively (i.e., instead of the clamping portion described above) include a reel securing portion for securing the internal cable reel against rotation in at least a cable loosening or cable withdrawing direction, to prevent movement of the cable within the cable passage in at least an outward or loosening direction. While many different types of reel securing portions may be utilized, in the illustrated embodiment, a reel securing portion or reel securing arrangement 160 (FIG. 3) includes a latching lever or other such latching member 161 that is biased (e.g., by spring 163) into a reel interlock position for engagement with an aligned one of a corresponding plurality of latch portions 164 (e.g., teeth) around a periphery of the reel 120. Interlocking engagement of the latching member 161 with the latch portion 164 prevents rotation of the reel in the cable loosening direction.

To allow for loosening or withdrawal of an additional portion of the cable from the housing, a locking mechanism may be provided that, when moved from a locked position to an unlocked position, causes or permits movement of the reel securing portion from the reel interlock position to a reel release position, for free rotation of the reel. In the illustrated embodiment, the latching member 161 includes an actuated portion 162 that is engaged when the locking mechanism 150 is moved to an unlocked position, for movement (e.g., pivoting movement, as shown) of an interlock portion 165 of the latching member out of engagement with the reel latch portions 164. While the actuated portion 162 of the latching member 161 may be engaged by any suitable portion of the locking mechanism (e.g., by the locking cam or by some other component), in the illustrated embodiment, the actuated portion extends adjacent to one of the clamp jaws 142 for engagement with the clamp jaw 142. When the locking cam 151 is rotated to engage the actuating portion 152 with the clamp jaws 141, 142 (e.g., when a lockout member of the locking mechanism is pivoted to the second position), clamp jaw 142 engages the actuated portion 162 of the latching member 161 to pivot the latching member 161 against biasing spring 163 to the reel release position for disengagement of the interlock portion 165 from the reel latch portions 164. Accordingly, in the illustrated embodiment, movement of the locking mechanism to the unlocked position, as shown in FIG. 2A, effects both movement of the clamp jaws 141, 142 to the release position and movement of the latching member 161 to the reel release position.

In the illustrated embodiment, the reel latch portion teeth 164 are contoured to permit rotation of the reel in the cable tightening direction, by engagement of angled camming surfaces of the teeth 164 with the interlock portion 165 of the latching member 161 to move the latching member against biasing spring 163 to the reel release position. In other embodiments (not shown), the locking mechanism may additionally or alternatively provide for a condition in which the locking mechanism secures the clamping portion in clamping engagement with the cable, such that the cable may not be tightened or cinched in such a condition. For example, the reel latch portions may include portions that are contoured (e.g., stepped instead of tapered) or otherwise configured to prevent movement of the latching member out of the interlock position in response to applied rotational forces to the reel in the cable loosening direction. This condition may coincide with the locked position of the locking mechanism, or may be provided as a third selectable position of the locking mechanism.

According to another exemplary aspect of the present application, a cable locking mechanism may include a cable having an exterior second end portion that terminates at a cable end connector that is insertable into a cable connection port in the housing for attachment of the second end portion of the cable to the housing of the locking device. In one such embodiment, the locking mechanism of the cable locking device may be additionally configured to secure the cable end connector within the cable connection port when the locking mechanism is in the locked position, and to permit removal of the cable end connector from the cable connection port when the locking mechanism is in the unlocked position.

In the illustrated embodiment, the second end portion 134 of the cable 130 terminates at a cable end connector 135 that is insertable into a cable connection port 118 in the housing 110. The cable end connector 135 is secured in the cable connection port 118 by a cable end securing portion or cable end securing arrangement 170 (FIG. 3) of the locking mechanism 140. While any suitable cable end securing arrangement may be utilized, in the illustrated embodiment, the cable end securing portion includes a cable end latch 171 that extends into the cable connection port 118 to engage a notched portion 139 of the cable end connector 135 when the cable end latch 171 is in a cable end securing position, and that disengages from the notched portion 139 when the cable end latch is in a cable end releasing position.

To allow for selective secure retention of a cable end connector within a cable connection portion in a locking device housing, a locking mechanism may be provided that, when moved from a locked position to an unlocked position, causes or permits movement of the cable end latch from the cable end securing position to the cable end releasing position, for detachment of the cable second end portion from the housing. In the illustrated embodiment, the cable end latch 171 includes an actuated portion 172 that is engaged when the locking mechanism 150 is in a locked position, thereby holding the cable end latch 171 in locking engagement with the notched portion 139 of the inserted cable end connector 135. When the locking mechanism is moved to an unlocked position, the actuated portion 172 is disengaged to permit movement of the cable end latch 171 to the cable end releasing position. While the actuated portion 172 of the cable end latch 171 may be engaged by any suitable portion of the locking mechanism (e.g., by the locking cam or by some other component), in the illustrated embodiment, the actuated portion 172 extends adjacent to the locking cam 151, such that when the locking cam 151 is rotated to engage the actuating portion 152 with the clamp jaws 141, 142 (e.g., when a lockout member of the locking mechanism is pivoted to the second position), the actuating portion 152 disengages from the cable end latch actuated portion 172 to permit disengagement of the cable end latch 171 from the notched portion 139 of the inserted cable end connector 135. Accordingly, in the illustrated embodiment, movement of the locking mechanism to the unlocked position, as shown in FIG. 2A, simultaneously effects movement of the clamp jaws 141, 142 to the release position, movement of the latching member 161 to the reel release position, and permits disengagement of the cable end latch 171 from the cable end connector 135.

While the cable end latch may be configured to automatically disengage from the cable end connector when the locking mechanism is moved to the unlocked position, in the illustrated embodiment, the locking device 100 is provided with a release button 178 that is depressible to slide the cable end latch 171 out of engagement with the cable end connector 135 when the locking mechanism 150 is in the unlocked position, with the locking cam 151 disengaged from the cable end latch 171. The cable end latch may be spring biased (e.g., by spring 173) toward the cable end securing position, to maintain attachment of the cable second end with the housing 110 until the cable end is selectively released by depressing the release button 178.

In the illustrated embodiment, the reel latch portion teeth 164 are contoured to permit rotation of the reel in the cable tightening direction, by engagement of angled camming surfaces of the teeth 164 with the interlock portion 165 of the latching member 161 to move the latching member against biasing spring 163 to the reel release position. In other embodiments (not shown), the locking mechanism may additionally or alternatively provide for a condition in which the locking mechanism secures the clamping portion in clamping engagement with the cable, such that the cable may not be tightened or cinched in such a condition. For example, the reel latch portions may include portions that are contoured (e.g., stepped instead of tapered) or otherwise configured to prevent movement of the latching member out of the interlock position in response to applied rotational forces to the reel in the cable loosening direction. This condition may coincide with the locked position of the locking mechanism, or may be provided as a third selectable position of the locking mechanism.

FIGS. 4-10 illustrate additional views of an exemplary cable locking device.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A cable locking device comprising:

a housing;

a reel at least partially disposed in the housing and rotatable in a first, cable tightening direction and a second, cable loosening direction;

a cable having a first end portion fixed to the reel and a second end portion extending outward through a cable passage in the housing;

at least one clamp member disposed in the housing, the at least one clamp member defining at least a portion of the cable passage, and being movable between a clamping position in which the at least one clamp member engages a portion of the cable disposed in the cable passage to prevent movement of the cable within the cable passage in at least an outward direction, and a releasing position in which the at least one clamp member permits movement of the cable within the cable passage in the outward direction; and a locking mechanism assembled with the housing and movable between a locked position and an unlocked position, the locking mechanism including a reel securing portion and a clamp member securing portion, wherein when the locking mechanism is in the locked position, the reel securing portion secures the reel against rotation in the cable loosening direction, and wherein when the locking mechanism is in the unlocked position, the clamp member securing portion secures the at least one clamp member in the releasing position;

wherein the locking mechanism comprises a user manipulable lockout member connected to the housing, the lockout member being movable to a first position to move the locking mechanism to the locked position, and movable to a second position to move the locking mechanism to the unlocked position; and wherein at least one of the lockout member and the housing comprises at least one lock aperture, wherein when the lockout member is in the first position, insertion of a padlock shackle through the at least one lock aperture prevents movement of the lockout member to the second position.

2. The cable locking device of claim 1, wherein the reel securing portion comprises a latching lever that engages an aligned one of a plurality of latch portions disposed around a periphery of the reel.

3. The cable locking device of claim 2, wherein the locking mechanism comprises a locking cam that pivots the latching lever out of engagement with the plurality of latch portions when the locking mechanism is moved from the locked position to the unlocked position, to permit rotation of the reel in the cable loosening direction.

4. The cable locking device of claim 3, wherein the locking cam is rotatable to pivot the latching lever.

5. The cable locking device of claim 1, wherein the reel securing portion is configured to permit movement of the cable within the cable passage in an inward direction when the locking mechanism is in the locked position.

6. The cable locking device of claim 1, wherein the clamp member securing portion comprises a locking cam that slides the at least one clamp member from the clamping position to the releasing position when the locking mechanism is moved from the locked position to the unlocked position.

7. The cable locking device of claim 6, wherein the locking cam is rotatable to slide the at least one clamp member.

8. The cable locking device of claim 1, wherein the clamp member securing portion is configured to permit rotation of the reel in the cable tightening direction when the locking mechanism is in the locked position.

9. The cable locking device of claim 1, wherein the at least one clamp member is spring biased toward the clamping position.

10. The cable locking device of claim 1, wherein the second end portion of the cable terminates at a cable end connector, the cable end connector being receivable in a cable connection port in the housing.

11. The cable locking device of claim 10, wherein the locking mechanism comprises a cable end securing portion, wherein when the locking mechanism is in the locked position, the cable end securing portion secures the cable end connector within the cable connection port, and when the locking mechanism is in the unlocked position, the cable end securing portion permits removal of the cable end connector from the cable connection port.

12. A cable locking device comprising:

a housing;

a reel at least partially disposed in the housing and rotatable in a first, cable tightening direction and a second, cable loosening direction, the reel including a plurality of latch portions disposed around a periphery of the reel;

a cable having a first end portion fixed to the reel and a second end portion extending outward through a cable passage in the housing; and a locking mechanism assembled with the housing and including a latch that engages an aligned one of the plurality of latch portions, and a locking cam that moves the latch out of engagement with the plurality of latch portions when the locking cam is moved from a locked position to an unlocked position, to permit rotation of the reel in the cable loosening direction;

wherein the locking mechanism comprises a user manipulable lockout member connected to the housing, the lockout member being connected to the locking cam and movable between a first position and a second position for movement of the locking cam between the locked position and the unlocked position; and wherein at least one of the lockout member and the housing comprises at least one lock aperture, wherein when the lockout member is in the first position, insertion of a padlock shackle through the at least one lock aperture prevents movement of the lockout member to the second position.

13. The cable locking device of claim 12, wherein the latch comprises a latching lever, wherein the locking cam pivots the latching lever out of engagement with the plurality of latch portions when the locking cam is rotated from a locked position to an unlocked position, to permit rotation of the reel in the cable loosening direction.

14. A cable locking device comprising:

a housing;

a cable having a first end portion retained within the housing and a second end portion extending outward through a cable passage in the housing and terminating at a cable end connector, the cable end connector being receivable in a cable connection port in the housing; and a locking mechanism assembled with the housing and movable between a locked position and an unlocked position;

wherein when the locking mechanism is in the locked position, the locking mechanism secures the cable against movement within the cable passage in at least an outward direction, and secures the cable end connector within the cable connection port; and wherein when the locking mechanism is in the unlocked position, the locking mechanism permits movement of the cable within the cable passage in the outward direction, and permits removal of the cable end connector from the cable connection port;

wherein the locking mechanism comprises a user manipulable lockout member connected to the housing, the lockout member being movable to a first position to move the locking mechanism to the locked position, and movable to a second position to move the locking mechanism to the unlocked position; and wherein at least one of the lockout member and the housing comprises at least one lock aperture, wherein when the lockout member is in the first position, insertion of a padlock shackle through the at least one lock aperture prevents movement of the lockout member to the second position.

15. The cable locking device of claim 14, wherein the locking mechanism comprises a cable end latch that is slideable between a first position in which the cable end latch interlocks with the cable end connector, and a second position in which the cable end latch disengages from the cable end connector.

16. The cable locking device of claim 15, wherein the locking mechanism comprises a locking cam that secures the cable end latch in the first position when the locking cam is in a first position, and that permits movement of the cable end latch to the second position when the locking cam is in a second position, wherein movement of the locking mechanism from the locked position to the unlocked position moves the locking cam from the first position to the second position.

17. The cable locking device of claim 15, wherein the cable end latch is spring biased toward the first position.

18. The cable locking device of claim 14, wherein the lockout member is pivotally connected to the housing for pivoting movement between the first and second positions.

19. The cable locking device of claim 14, further comprising a reel at least partially disposed in the housing and rotatable in a first, cable tightening direction and a second, cable loosening direction, with the cable first end portion fixed to the reel, wherein when the locking mechanism is in the locked position, the locking mechanism secures the reel against rotation in the cable loosening direction.

20. The cable locking device of claim 14, wherein the locking mechanism comprises at least one clamping member that clamps against a portion of the cable within the cable passage to secure the cable against movement within the cable passage in the outward direction when the locking mechanism is in the locked position.

* * * * *